United States Patent [19]

Krent et al.

[11] Patent Number: 4,776,590

[45] **Date of Patent: * Oct. 11, 1988**

[54] VIBRATION DAMPENING DEVICE FOR SPORTING RACKETS

[76] Inventors: Edward D. Krent, 207 Hampton Rd., Sharon, Mass. 02067; Nicholas B. Paffett, 250 Whitwell St., Quincy, Mass. 02169

[ * ] Notice: The portion of the term of this patent subsequent to Sep. 2, 2003 has been disclaimed.

[21] Appl. No.: 855,139

[22] Filed: Apr. 23, 1986

Related U.S. Application Data

[63] Continuation of Ser. No. 615,310, May 30, 1984, Pat. No. 4,609,194.

[51] Int. Cl.[4] ..... A63B 51/10; A63B 51/00

[52] U.S. Cl. ..... 273/73 R; 273/73 D

[58] Field of Search ..... 273/73 R, 73 D, 73 C, 273/29 A, DIG. 8, 58 R, 58 A, 58 BA; 272/67, 135; 128/26, 152, 151; 124/90, 92; 49/9; 84/234, 255, 216, 310, 267; 604/358; 174/42; 248/562, 636; 181/207, 208, 200, 202; 428/306.6, 314.4, 314.8; 173/139; 464/180

[56] References Cited

U.S. PATENT DOCUMENTS

| | | | |
|---|---|---|---|
| 2,538,339 | 1/1951 | Thomas | 128/152 |
| 3,764,146 | 10/1973 | Vogel | 273/DIG. 8 |
| 3,811,437 | 5/1974 | Gardner | 128/152 |
| 3,857,133 | 12/1974 | Lihenfelser | 428/316.6 X |
| 3,861,993 | 1/1975 | Guthrie | 428/316.6 X |
| 3,971,287 | 7/1976 | Ito | 84/207 X |
| 4,180,265 | 12/1979 | Staufer | 273/73 D |
| 4,215,763 | 8/1980 | Pasko | 181/202 |
| 4,394,015 | 7/1983 | Bosnia | 273/DIG. 8 |
| 4,575,083 | 3/1986 | Adam | 273/73 D |
| 4,589,662 | 5/1986 | Robaldo | 273/73 D |
| 4,732,383 | 3/1988 | Ferrari et al. | 273/73 D |

FOREIGN PATENT DOCUMENTS

| | | | |
|---|---|---|---|
| 1398833 | 4/1965 | France | 273/73 D |
| 81/03431 | 12/1981 | Int'l Pat. Institute | 273/73 R |

*Primary Examiner*—Richard C. Pinkham
*Assistant Examiner*—William E. Stoll
*Attorney, Agent, or Firm*—Wolf, Greenfield & Sacks

[57] ABSTRACT

A vibration dampening device for use with hand held sporting rackets, particularly tennis rackets, having a face or striking surface formed of two intersecting sets of parallel strings. The device of this invention comprises a block of viscoelastic foam which is compressed and inserted between the strings on the striking surface. This block of foam is preferably in the shape of a cylinder and when it is inserted between two, adjacent parallel strings it assumes a generally spherical shape. Typically, this compressed block engages four adjacent strings of both sets of strings, or three strings and the racket frame. This block may be placed at various positions on the racket striking surface, and significantly reduces vibrations created in the racket by the striking of a projectile, such as a ball. The device may be constructed of various combinations of different types of foam, and may have any desired color or design.

18 Claims, 3 Drawing Sheets

VIBRATION DAMPENING DEVICE FOR SPORTING RACKETS

This application is a continuation of application Ser. No. 615,310, filed May 30, 1984, now U.S. Pat. No. 4,609,194.

FIELD OF THE INVENTION

This invention relates generally to vibration dampening devices, and more particularly to vibration dampening devices for hand held sporting rackets having a strung striking surface.

BACKGROUND OF THE INVENTION

Most strung hand held sporting rackets have a striking surface or face formed of two intersecting sets of parallel strings suspended by and enclosed by an oval frame. One set extends generally parallel to the handle of the racket and may be called the longitudinal strings, while the other set extends generally transversely of the handle and may be called the transverse strings. In such rackets, vibrations are produced in the racket face when a projectile is struck. These vibrations are most noticeable in rackets used in playing games involving a ball, particularly tennis. The vibrations are most severe when the ball does not strike the racket face in the center thereof, but strikes it at a distance spaced from the center or when the hit is not considered to be a "solid" hit. Initially, rather large vibration is detected in the racket face and this initial vibration is followed by a series of smaller vibrations which eventually die out with time. Such vibrations are transmitted generally along the transverse and longitudinal strings of the racket, to the frame surrounding and holding the strings, and eventually down the racket handle to the hand and then the arm of the player. The more one plays, the greater is the exposure to such vibrations. It has been shown that a player who has been subject to extensive periods of racket-induced vibrations can sustain injury to his or her arm. Thus, it is considered desirable to reduce such vibrations both for the comfort of the player and for the protection of the player.

In recent years, the use of composite racket constructions and other advanced technologies has allowed the tension of the racket strings to be increased to levels of 75 pounds or more. These higher tensions produce greater and more sustained vibration levels in the racket face and also a greater transfer of vibrations to the handle.

In the past, most efforts at reducing these vibrations have been directed towards the racket construction. Such efforts have included changing the structural material of the racket, and in recent years, fibrous materials such as carbon fibers and boron fibers have been added to the racket head and handle structure. Some previous efforts at reducing vibrations by modifying the racket structure are shown in U.S. Pat. Nos. 3,941,380 and 2,732,209. However, even with these improved racket constructions, vibrations still persist. In addition, different types of racket strings are known to inhibit vibrations better than others. In particular, strings made of natural catgut have a lower tendency to produce vibrations than plastic strings. However, other considerations enter into the choice of materials for the racket and for the strings, and often players prefer materials for higher performance which do not necessarily produce a lower level of vibration.

Another device for dampening the vibrations in the racket strings is shown in U.S. Pat. No. 4,180,265. In this device, two strings are coupled together by a device which interlocks them. However, the device shown in this patent has not been entirely successful in reducing vibrations in rackets, particularly in tennis rackets. In addition, the device shown in U.S. Pat. No. 4,180,265 is sometimes difficult to attach to the racket face, and can interfere with the flight of the ball if struck by the ball.

Other devices which interconnect the strings of a racket face for other purposes include U.S. Pat. Nos.: 4,368,886; 3,921,979; 4,078,796; 4,168,065; and 1,682,199.

SUMMARY OF THE INVENTION

It is an object of this invention to provide a vibration dampening device for sporting rackets having a strung striking surface which performs in a manner superior to prior art vibration dampening devices.

It is a further object of this invention to provide vibration-dampening device for strung sporting rackets which can be easily inserted into and removed from the racket face.

It is another object of this invention to provide a vibration-dampening device for strung sporting rackets which does not interfere with the flight of the ball, and which can be placed in any position on the racket face to provide optimal dampening of vibrations.

In accordance with the above-described objects, a vibration-dampening device is provided which operates by mechanically isolating two transverse strings and at least one longitudinal string or two longitudinal strings and at least one transverse string without interlocking them. This device is a block of vibration absorbing, viscoelastic foam which is compressed and inserted between two adjacent parallel strings of the racket face. Preferably, the block is in the shape of a cylinder. A cylindrically shaped device is compressed parallel to the axis of the cylinder, and when inserted between two adjacent, parallel strings, the cylinder assumes a generally spherical shape. Typically, if the block is placed between two longitudinal strings, the two adjacent parallel transverse strings, or one adjacent transverse string and the frame will also be engaged as the block expands under the influence of its own elasticity.

The device may be placed at any position on the racket face, at the discretion of the user, to produce optimal dampening characteristics. One option is to place the device at the center of the racket. In this position, the device also serves as a target and it may be used as a learning device for beginning players to assist them in placing the ball in the center of the racket. Another option is to place the device at the bottom, center of the racket so that the device engages the lower most transverse string and the two center longitudinal strings, as well as the bottom edge of the racket frame. Other positions may be selected at the discretion of the player which produce optimal results for the string type and tension of that particular racket and for that particular player.

A preferred material for the device is an open cell, urethane foam or a composite open and closed cell urethane foam. Such a material has the desired memory and dampening properties. It is also sufficiently light and flexible that it does not affect the flight of the ball if struck by it.

Other variations of the basic device of this invention are possible. Different combinations of higher resilience and lower rebound acoustic elastomer foams may be used in layers. In particular, a sandwich may be formed of higher resilience elastomers in the center of the cylinder extending along the axis thereof and of a lower rebound acoustic material along the outer surfaces of the cylinder. In another embodiment, the top and bottom bases of the cylinder may be formed of a composite open and closed cell acoustic, lower rebound elastomer, while the central portion of the cylinder is formed of a higher rebound, high resilience, open cell elastomer. The lower rebound elastomer produces more dampening, while the higher rebound has greater elasticity and memory to keep the strings under constant pressure.

It has been discovered that the device of this invention produces dampening results far superior to those achieved with all prior art devices, and this device is easily inserted onto and removed from or relocated on the racket face as desired.

DESCRIPTION OF THE DRAWINGS

The invention will be more fully understood from the following detailed description taken in conjunction with the accompanying drawings, in which.

DETAILED DESCRIPTION OF THE INVENTION

Figure 1:
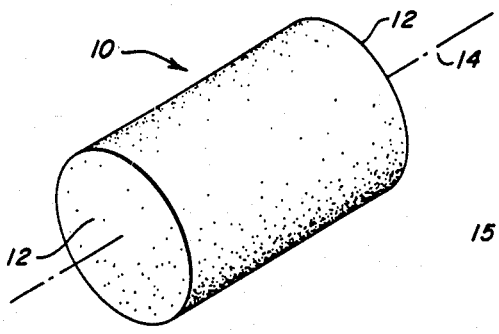
FIG. 1 is a perspective view of the device of this invention.

Referring now to FIG. 1, there is shown a dampening device 10 embodying the invention. Device 10 is a block of compressible, viscoelastic foam. Although device 10 may have any desired shape, device 10 preferably has a generally cylindrical shape with a pair of bases 12, and is preferably generally symmetric about a central axis 14 running between bases 12. Device 10 is sufficiently viscoelastic so that it continually returns to its original shape after it has been compressed and also so that it absorbs vibrations generated in the racket face. Device 10 should also be sufficiently flexible to permit device 10 to be easily compressed into a small space and sufficiently light weight so that it does not affect the balance of the racket face. A preferred material for forming device 10 of this invention should have the following properties as defined in ASTM Standard D-3574: 1. high compression force deflection (CFD), typically in the range of 60 to 100 pounds; 2. low compression set value; and 3. a minimum rebound of 50% to 60% under Test H. Materials which are suitable include an open cell foam, and a composite open and closed cell foam, preferably a urethane foam. However, other types of foam can also be used, such as certain closed cell foams, rubber foams or synthetic rubber foams. The material of device 10 preferably has a density in the range of 1.5 to 8 pounds/ft$^3$, but other density foams also may be suitable if they meet the foregoing requirements.

Figure 2:
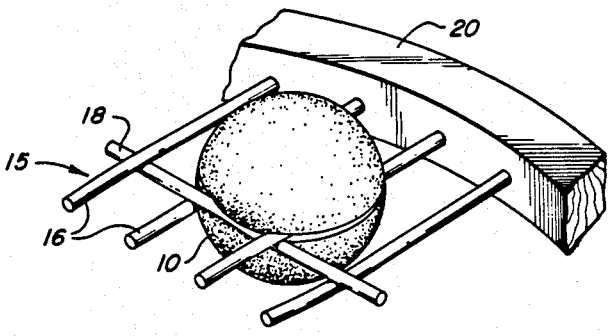
FIG. 2 is a perspective, cutaway view of a portion of a racket face showing the device of FIG. 1 when inserted on the racket face.

With reference now to FIG. 2, implementation of device 10 will now be described. A typical racket face 15 having a strung striking surface, such as a tennis racket face, consists of a first set of generally parallel transverse strings 18 and a second set of generally parallel longitudinal strings 16. Strings 16 and 18 are generally at right angles and are interwoven with each other. Strings 16 and 18 extend between and are tensioned on an oval frame 20 which surrounds racket face 15. Only a portion of racket face 15 is shown in FIG. 2 for purposes of illustration.

Figure 5A:
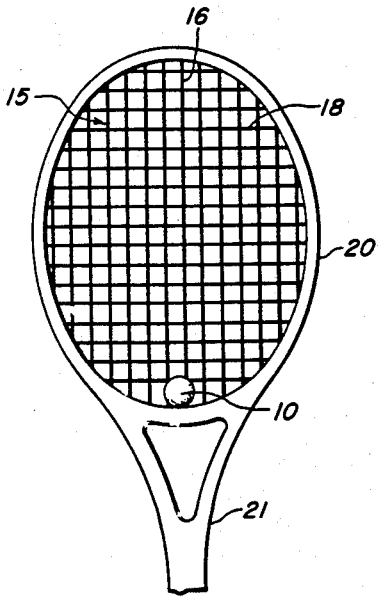
FIG. 5A is a front view of a racket face showing the device of FIG. 1 inserted in one position.

Device 10 is shown in FIG. 2 deployed in one exemplary location at the base of racket face 15, in the same position shown in FIG. 5A. Although this is a preferred position, other positions are possible as will be described hereinbelow. If cylindrical, device 10 is deployed by first compressing bases 12 toward one another generally along axis 14. When bases 12 are spaced less than the distance between adjacent, parallel strings 16 or 18, device 10 can be inserted into the space therebetween. The memory of device 10 causes it to expand once it has been released and placed between strings 16 or 18. Thus, bases 12 press outwardly against adjacents strings 16 or 18, urging them away from one another. This elasticity of device 10 causes each base 12 to curve around its associated string 16 or 18 so that opposite edges of base 12 nearly touch one another and base 12 almost completely encircles associated string 16 or 18. At the same time, some expansion occurs in a direction perpendicular to axis 14, so that the lateral sides of device 10 also contact adjacent strings 16 or 18 which are generally normal to the strings 16 or 18 associated with bases 12. Also, in the position shown in FIG. 2, device 10 may contact an adjacent portion of frame 20. If device 10 has a cylindrical shape, because of the elastic properties thereof, device 10 assumes a nearly spherical shape when in position between two strings 16 or 18, as shown in FIG. 2. As a result, the wind resistance or drag coefficient of device 10 when in place during use of the racket is minimized. Also, because of the light weight of device 10, little or no weight is added to the racket face and neither the balance of the racket nor the performance thereof is affected.

Device 10 dampens vibrations in racket face 15 by mechanically isolating two transverse strings 18 and at least one longitudinal string 16 or two longitudinal strings 16 and at least one transverse string 18 by pressing against the strings without interlocking them. Because the device presses outwardly and engages at least three and usually four strings of a racket, or three strings and the frame, one device is able to effectively dampen vibrations in both the longitudinal and the transverse strings of the racket face, as well as in the frame of the racket. The foam comprising device 10 traps the vibrations and turns the mechanical vibrational energy into heat energy which is dissipated.

Various suggested positions of device 10 on the racket face are shown in FIGS. 5A–5D. As previously indicated, the location of device 10 in FIG. 5A is preferred and is the same as that shown in FIG. 2. In FIG. 5A, device 10 is shown in contact with frame 20, as well as with two spaced strings 16, and adjacent string 18. It is preferred that device 10 be centered on the racket face with regard to strings 16, so that it has the optimum dampening effect. Thus, in a preferred position, bases 12 of device 10 engage the two most centrally positioned longitudinal strings 16 and the lateral sides of device 10 touch the lowermost transverse string 18 and an adjacent portion of frame 20 near handle 21. However, off center positions may also be selected if desired.

Figure 5B:
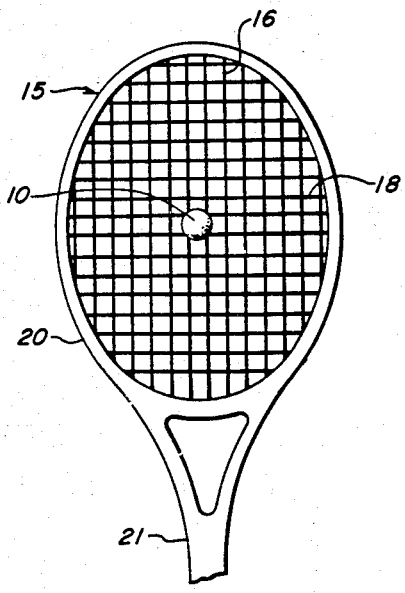
FIG. 5B is a front view of a racket face showing the device of FIG. 1 inserted in a another position.

FIG. 5B shows another preferred location on racket face 15 for device 10. In FIG. 5B, device 10 is positioned generally in the center of racket face 15. In FIG. 5B, device 10 engages the adjacent, centrally disposed pair of transverse strings 18 and the adjacent centrally disposed pair of longitudinal strings 16. Preferably, bases 12 of device 10 engage longitudinal strings 16; however, device 10 may be positioned so that bases 12 engage transverse strings 18 if desired. In this manner, device 10 mechanically isolated four adjacent strings by vibration absorbing means, thus dampening vibrations in the entire racket face 15. This position is particularly suggested for beginning players who have difficulty hitting the projectile at the center of face 15. In the position in FIG. 5B, device 10 serves as a target for the player to assist him in striking the ball or other projectile in play at the center of the racket face 15, and for this purpose, device 10 may be provided with a bright, highly visible color. Since device 10 is highly flexible and light weight, when it is struck by the ball or other projectile in play, device 10 comprises against racket face 15 and does not affect the flight of the projectile and does not alter the manner in which it is struck. In tennis, device 10 in the position of FIG. 5B guides the player and assists in developing proper hand-eye coordination. In addition, device 10 forces the player to strike the ball with the racket when it is in front of the player and with the arm in the proper position so that the likelihood of "tennis elbow" or other joint related injuries is reduced. In addition, because vibrations are damped, the likelihood of formation of injury is further reduced.

Figure 5C:
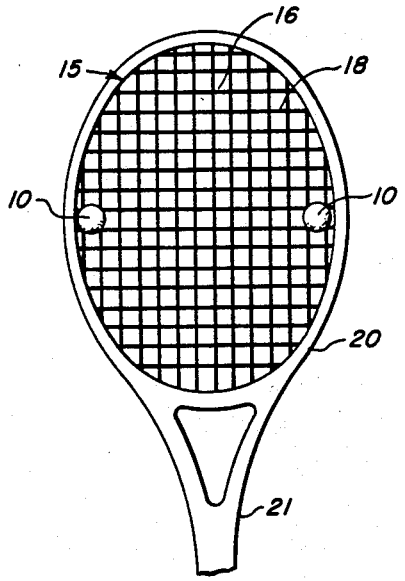
FIG. 5C is a front view of a racket face showing the positioning of two devices of FIG. 1.
Figure 5D:
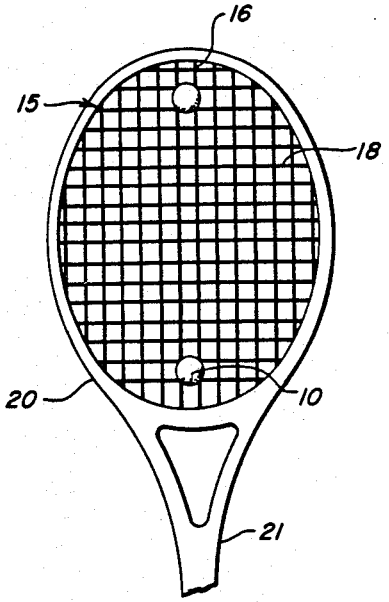
FIG. 5D is a front view of a racket face showing an alternative positioning of two devices of FIG. 1.

Other suggested positions for device 10 are shown in FIGS. 5C and 5D. In these examples, the use of two such devices 10 is illustrated, each device being positioned at an opposite side of the racket. In FIG. 5C, the devices 10 are centrally disposed in the longitudinal direction of the racket face 15 and are positioned on opposite transverse sides of racket face 15. In FIG. 5C, devices 10 are centrally disposed in the transverse direction on racket face 15 and are positioned on opposite longitudinal sides of racket face 15. In each instance, device 10 engages or isolates four intersecting strings, two of which pass through the center of the racket face 15, to provide the desired dampening effect.

Figure 6:
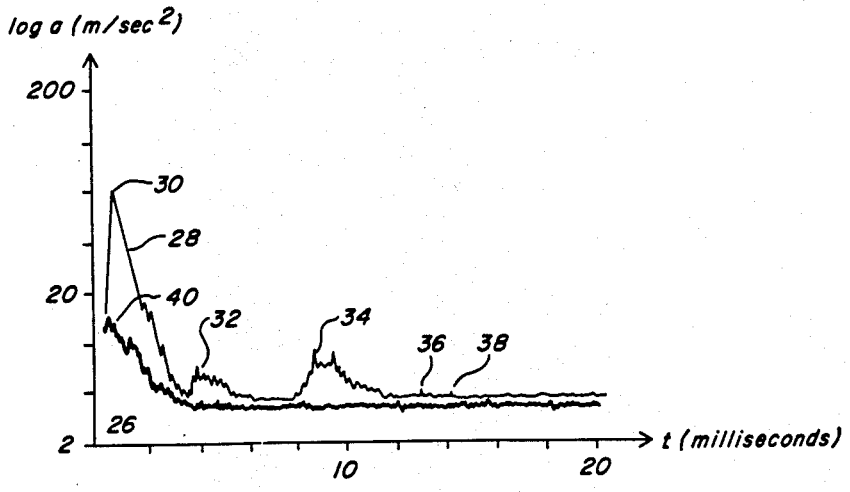
FIG. 6 is a graph showing the performance of the device of this invention in which the horizontal axis is time and the vertical axis is a logarithmic representation of the acceleration in meters per second of the racket face.

With reference now to FIG. 6, the significant reduction of vibrations in a racket resulting from the use of device 10 is graphically illustrated. FIG. 6 is a plot of the logarithm of the acceleration of the racket strings measured in m/sec$^2$ on the vertical axis versus time in milliseconds on the horizontal axis.

The measurements in FIG. 6 were made by attaching a miniature accelerometer to the throat of a graphite, composite mid-size tennis racket held by a player. For the purpose of measurements in FIG. 6, device 10 was placed roughly in the position shown in FIG. 5A. In each case, a ball was fired at the racket at a distance of 20 feet from a gun having a fixed muzzle velocity. The ball was struck by the player in roughly the center of the racket face under conditions approximating playing conditions. Measurements were then made of the vibrations in the frequency range by approximately 10 Hz to 40 kHz. The signal generated by the accelerometer was passed through a preamplifier, a variable filter in the range of 10 Hz to 100 kHz, a true RMS averager and logarithmic amplifier, and ultimately to a standard storage oscilloscope which supplied the signals indicated with an envelope time constant of 0.3 milliseconds.

Curve 28 illustrates the resulting vibrations observed on a tennis racket face when it has been struck by a ball and no device 10 has been employed. An initial peak 30 results from the impact of the ball on the strings. Thereafter, the strings continue to vibrate, exhibiting a series of smaller peaks or aftershocks 32, 34, 36 and 38 which are caused by the impact of the ball and which eventually dampen to nearly zero after about fourteen milliseconds. In contrast, curve 26 of FIG. 6 shows the pattern of vibrations resulting from the impact of the ball when device 10 is employed. When the racket strikes the ball, initial peak 40 results which is much smaller than peak 30 of curve 28. Curve 26 is rapidly damped to nearly zero by device 10, and only very small additional peaks 29 are observed. In curve 26, the vibrations are effectively completely eliminated after about four milliseconds. This period of vibrations is about only one-third as long as that observed when device 10 was not employed. In addition, as can be seen from FIG. 6, the magnitude of the vibrations, including both the initial one caused by impact with the ball, and the later aftershocks, are significantly reduced. The aftershocks or peaks 32 and 34 of curve 28 are almost completely missing from curve 26, and are only manifested as a series of very minor blips which are hardly registerable.

Figure 3:
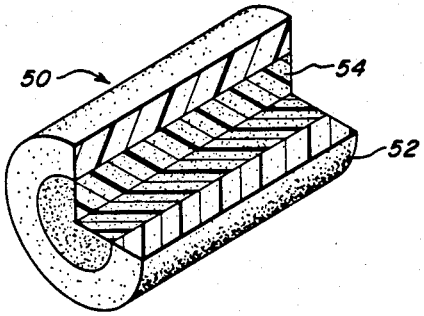
FIG. 3 is a cutaway, perspective view of an alternative embodiment of the device of FIG. 1.

Other embodiments of this invention are illustrated in FIGS. 3, 4, 7, 8, 9, 10 and 11. In each of these embodiments, devices are formed utilizing different foams having different viscoelastic properties. In FIG. 3, a device 50 is shown which has a central cylindrical core 54 and an outer annular shaped portion 52. Core 54 is preferably formed of an acoustic foam which has higher dampening properties and which has lower rebound properties than annular portion 52. Annular portion 52 is typically formed of a material which has high rebound and high resilience characteristics and which has properties falling within the limitations under ASTM standard D-3574 previously set forth. An example of the material which may be used in core 54 is an acoustic polyether which can either be a composite closed and open cell foam or an open cell foam. An example of the material which may be used in outer annular portion 52 is a polyester-polyether foam that has high resilience, and a preferred density of about two to three pounds per cubic foot.

Figure 4:
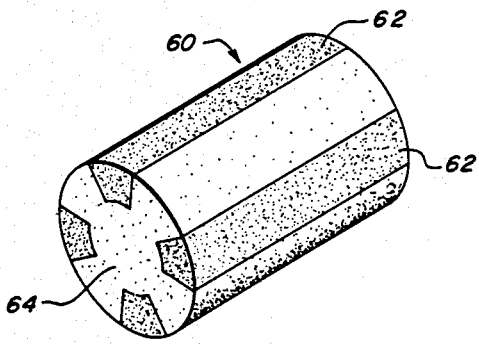
FIG. 4 is a perspective view of another alternative embodiment of the device of FIG. 1.

FIG. 4 shows another cylindrical device 60 formed of two different types of foam. Device 60 is has a central portion 64 and axially extending segments 62 which are inserted in channels formed in central portion 64. Portion 64 composed of a higher rebound foam than segments 62 which has properties falling within the limitations under ASTM standard D-3574 previously set forth. An example of the foam of portion 64 is the polyester-polyether foam previously referenced. Segments 62 are typically formed of an acoustic foam which has lower rebound properties than portion 64, an example of which is an acoustic polyether. Segments 62 have a generally trapezoidal cross-sectional shape as viewed from base 66, and segments 62 extend along the entire axial length of device 60. Four such segments are shown, although more may be provided.

The devices of both FIG. 3 and FIG. 4 have the desired elasticity and the desired softness so that they do not interfere with the flight of a projectile when hit, and in addition, they are provided with greater vibration absorbing properties because of the inclusion of acoustic foam portions which have greater dampening properties.

Figure 7:
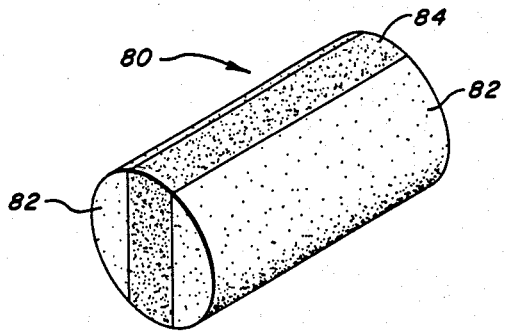
FIG. 7 is a perspective view of another embodiment of the device of FIG. 1.

FIG. 7 also shows a cylindrical device 80 formed of two different foams. Device 80 includes a central portion 84 which extends along a diameter in one direction along the entire axial length thereof in the other direction. Disposed on each lateral face of portion 84 is an outer portion 82 which extends the entire axial length of device 80. Portions 82 typically are symmetrical about portion 84 and each have a partially circular cross-section bounded by a chord that does not pass through the center of the circular base of device 80. Portions 82 are formed of a foam which has properties as previously set forth under ASTM standard D-3574, such as a polyester-polyether foam. Central portion 84 is formed of a foam which has lower rebound properties than those of portions 82, such as an acoustic foam made of polyether.

Figure 8:
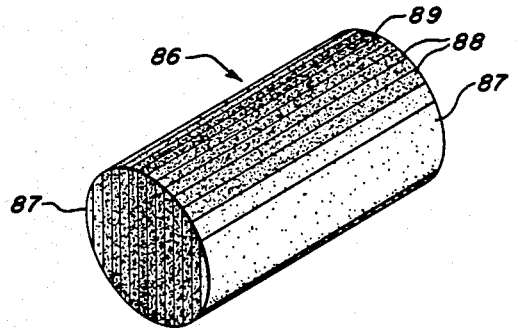
FIG. 8 is a perspective view of an alternative embodiment of the device of FIG. 7.

FIG. 8 shows an alternative to the embodiment of FIG. 7. In FIG. 8, cylindrical device 86 is formed of a plurality of axially extending slabs 88. Each slab 88 has a similar thickness and extends the entire axial length of device 86 in one direction. The transverse dimension of each slab 88 is defined by a pair of parallel chords extending across the circular base of device 86. Each slab 88 is typically formed of a different foam, and the rebound characteristics of the foams selected decreases as one moves from the outside of the cylinder towards its center so that slab 89 is formed of a foam having the greatest dampening properties, and slabs 87 are formed of a foam having the greatest memory and the greatest resilience. A preferred example of the foam used to form slab 89 is an acoustic polyether, while an example of the preferred foam for forming slabs 87 is a polyester-polyether foam.

Figure 9:
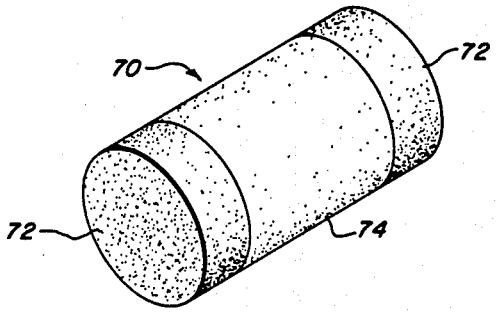
FIG. 9 is a perspective view of another embodiment of the device of FIG. 1.

In FIG. 9, a cylindrical device 70 is shown having three sections. There is a central section 74, and two end caps or discs 72 which are of about equal thickness. Central section 74 is composed of a higher rebound elastomer foam than caps 72 and section 74 typically ha the properties previously set forth under ASTM standard D-3574. An example of the material of section 74 is a polyester-polyether foam. Caps 72 are formed of a lower rebound elastomer than section 74, an example of which would be an acoustic polyester. In device 70, the portion thereof which contacts the strings of the racket face is provided with greater dampening properties, while the central portion 74 which biases end caps 72 against the strings has the desired high resilience. In addition, portion 74 is the part of device 70 which would be exposed to a projectile which strikes the racket, and since it has the required high resilience and low weight, the trajectory of the projectile remains unaffected.

Figure 10:
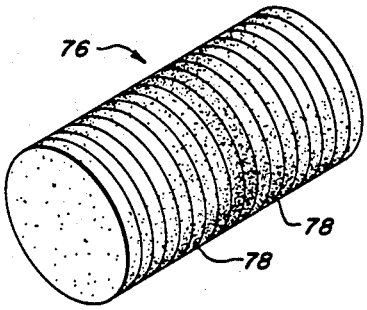
FIG. 10 is a perspective view of an alternative embodiment of the device of FIG. 9.

FIG. 10 shows an alternative embodiment of the device of FIG. 9. In FIG. 10, device 76 is comprised of a plurality of discs 78 aligned generally perpendicularly of the axis of device 76. Discs 78 are secured to one another, each disc having approximately the same axial thickness and the same circular cross-section. The discs 78 at the ends of device 76 are formed of the lowest rebound foam with the greatest dampening properties. The discs 78 have greater rebound characteristics as one passes from the ends towards the center of device 76, so that the disc formed of the foam with the greatest resilience is disposed at the center of device 76. As a result, the discs with the greatest dampening properties are in direct contact with the strings, while the central portion of the device provides the desired resilience and memory to bias the end discs against the strings. Also, because of the resulting spherical shape of device 76 when inserted, the central portion of device 76 is the part which is struck by the projectile and also is the part which has the resilience required to not affect the path of the projectile.

Devices 10, 50, 60, 70, 76, 80 and 86 each typically has the same shape and dimension and is employed in the same manner on the racket face. As indicated, a preferred shape is cylindrical with the optimal size being a cylinder of about $\frac{7}{8}$ inch diameter. However, good results can be achieved with a cylinder as small as $\frac{1}{2}$ inch diameter or a cylinder as great as 1 inch in diameter. If the cylinder becomes too large, much larger than about 1 inch diameter, it begins to exert a measurable amount of drag on the racket face and is much less desirable. If the cylinder is less than about $\frac{1}{2}$ inch in diameter, it is not sufficiently large to contact all four of the intersecting strings of the racket face. A typical axial length of the cylinder would be about $1\frac{1}{2}$ inches, although this dimension could be shorter or longer depending upon the resilient characteristics of the foam used, and depending upon the type of racket with which the device is to be employed.

Figure 11:
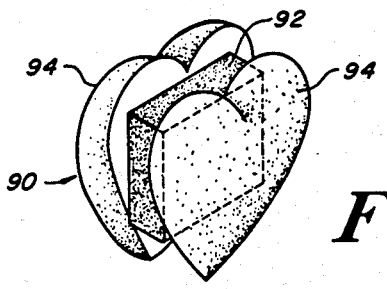
FIG. 11 is a perspective view of a further embodiment of this invention.

With reference to FIG. 11, another embodiment of the vibration dampening device of this invention is shown. Device 90 includes a central portion 92 and two outer portions 94 affixed thereto. Both central portion 92 and outer portions 94 are formed of a compressible, viscoelastic plastic foam. Central portion 92 is adapted to be compressed and inserted into the space defined by two adjacent, parallel transverse strings intersecting two adjacent, parallel longitudinal strings. Typically, central portion 92 would intersect or engage each of the four strings. Outer portions 94 are shown in FIG. 11 as extending beyond the lateral surfaces of central portion 92, but portions 94 also could have a cross-sectional area less than that of central portion 92. Outer portions 94 do not press against the strings of face 15 and are not in the plane thereof. In the embodiment as shown in FIG. 11 where portions 94 extend beyond the lateral edges of central portion 92, portions 94 overlie and presumably touch adjacent strings of racket face 15. Portions 94 could have any desired shape or configuration, such as the heart shape shown in FIG. 11. Dampening of string vibrations is provided both by the effect of central portion 92 pressing outwardly to engage adjacent strings, and by the effect of outer portions 94 touching strings on face 15. Preferably, central portion 92 is formed of an acoustic foam which has higher dampening properties and lower rebound properties than the material forming outer portions 94. The preferred position on the racket face 15 for device 90 is that shown in FIG. 5A, although any of the other suggested positions would also be acceptable.

The foregoing invention has numerous features and characteristics which render it superior to prior devices. One important characteristic is that the device may be easily attached to and removed from the racket after the racket has been strung. Each racket must be individually tailored to the needs of the particular player and his game. Every racket is somewhat different from other racket, depending on how it is strung and depending upon its particular construction. The characteristics of a particular racket which would affect the positioning of the device, or the number of devices used, or the foam composition of the device are the balance, the string tension, the type of game being played, whether the user is serving or volleying, and the vibration characteristics of the racket frame and materials. Thus, this invention allows a player to empirically determine for himself which position he prefers, which particular type of device he prefers, and which device performs best for that particular racket. In addition, should the device become worn out, it is readily replaceable.

Another advantage of this particular device is that it may be placed in the center of the racket to be used as a target, particularly for beginners, to allow the projectile or ball to be struck directly in the center of the racket face. Probably the most significant feature of this invention is its superior vibration dampening effects.

In view of the above description, it is likely that modifications and improvements will occur to those skilled in the art which are within the scope of this invention. The above description is intended to be exemplary only, the scope of the invention being defined by the following claims and their equivalents.

What is claimed is:

1. A device for dampening vibrations in the striking surface of a hand held sporting racket having strings, said dampening device comprising a block formed of two different, highly resilient foam materials, said block being adapted to be compressed together and inserted between strings on the striking surface of the sporting racket, said foam materials having a low compression set value, and a minimum rebound of about 50 percent to about 60 percent.

2. A device as recited in claim 1 wherein one material of said block is formed of a urethane, open cell foam.

3. A device as recited in claim 1 wherein said block is generally in the shape of a cylinder having a base at each end and a central axis extending between the bases.

4. A device as recited in claim 3 wherein said block assumes a generally spherical shape when inserted between the strings on the striking surface of the sporting racket.

5. A device as recited in claim 1 wherein said block has opposite ends spaced from one another and wherein said one material is disposed in the center of said block and said other material completely surrounds said one material between said opposite ends.

6. A device as recited in claim 1 wherein said block is elongated and has opposite ends spaced from one another in the direction of elongation, and wherein said opposite ends of said block are formed only of said one material and wherein the remainder of said block is formed of said other material.

7. A device as recited in claim 1 wherein said block is formed of a plurality of stacked layers of foam, each layer extending across said block generally parallel to opposite ends of said block, each layer being formed of a foam of different rebound and dampening properties.

8. A device as recited in claim 1 wherein said block of highly resilient foam is formed of two different foam materials having two different chemical compositions, one material having a lower rebound property and a higher dampening proerty than the other of the materials.

9. A hand held sporting racket for striking a moving projectile comprising:

a handle having a first end adapted to be gripped by the hand of a player, and a second end;

a frame secured to said second end of said handle;

a striking surface surrounded by said frame, said striking surface comprising a first set of generally parallel longitudinally extending strings and a second set of generally parallel transversely extending strings, said transverse strings intersecting said longitudinal strings, said transverse strings and said longitudinal strings each intersecting said frame; and at least one block of highly resilient foam compressed and inserted into said striking surface in contact with at least one longitudinal string and at least one transverse string, said block remaining in a compressed state and pressing outwardly against said longitudinal string and against said transverse string for preventing play of said block with respect to said longitudinal string and said transverse string and for dampening vibrations in the striking surface.

10. A racket as recited in claim 9 wherein said block is disposed at the transverse center of said striking surface and adjacent said frame where said frame is secured to said second end of said handle.

11. A racket as recited in claim 9 wherein said block is composed of at least two foams having different rebound properties.

12. A racket as recited in claim 9 wherein said block is disposed at the transverse and longitudinal center of said striking surface.

13. A racket as recited in claim 9 further comprising a second highly resilient foam block inserted between a second selected pair of adjacent longitudinal strings and a second selected pair of adjacent transverse strings, said second block being spaced from said one block.

14. A racket as recited in claim 9 wherein said block has a generally spherical shape when inserted between said selected pairs of strings.

15. A racket as recited in claim 9 wherein said highly resilient foam block is disposed between two adjacent longitudinal strings.

16. A racket as recited in claim 9 wherein said block of highly resilient foam is disposed between two adjacent transverse strings.

17. A racket as recited in claim 9 wherein said foam block is formed of a material which has a low compression set value, and a minimum rebound of about 50 percent to about 60 percent.

18. A hand held sporting racket for striking a moving projectile comprising:

a handle having a first end adapted to be gripped by the hand of a player and a second end;

a frame secured to said second end of said handle;

a striking surface surrounded by said frame, said striking surface comprising a first set of generally parallel longitudinally extending strings and a second set of generally parallel transversely extending strings, said transverse strings intersecting said longitudinal strings; and at least one block of highly resilient foam compressed and inserted into said striking surface in contact with at least one longitudinal string and at least one transverse string for dampening vibrations in the striking surface, said block being composed of at least two foams having different rebound properties.

* * * * *